US006467743B1

(12) United States Patent
Shiojima

(10) Patent No.: US 6,467,743 B1
(45) Date of Patent: Oct. 22, 2002

(54) TOOL FOR DISPLAYING COMMODITIES

(75) Inventor: Teruo Shiojima, Tokyo (JP)

(73) Assignee: Sembi Studio Company Limited, Tokyo (JP)

( * ) Notice: Subject to any disclaimer, the term of this patent is extended or adjusted under 35 U.S.C. 154(b) by 0 days.

(21) Appl. No.: 09/901,707

(22) Filed: Jul. 11, 2001

(51) Int. Cl.[7] ..... A47B 96/06

(52) U.S. Cl. ..... 248/214; 248/215; 248/223.31; 211/94.01

(58) Field of Search ..... 211/94.01, 162; 248/214, 215, 221.11, 223.31, 224.7

(56) References Cited

U.S. PATENT DOCUMENTS 3,857,643 A * 12/1974 Bardocz ..... 403/63
4,498,693 A * 2/1985 Schindele ..... 285/137
4,703,570 A * 11/1987 Fast ..... 40/19.5
4,807,659 A * 2/1989 Schindele ..... 137/360
4,869,378 A * 9/1989 Miller ..... 211/94
5,439,120 A * 8/1995 Brozak ..... 211/59.1
5,626,243 A * 5/1997 Brozak, Jr. ..... 211/59.1

FOREIGN PATENT DOCUMENTS

JP 58131765 * 6/1983 ..... 248/214
JP 129086 * 7/1985 ..... 248/214

* cited by examiner

*Primary Examiner*—Kimberly T. Wood
(74) *Attorney, Agent, or Firm*—Kanesaka & Takeuchi

(57) ABSTRACT

A tool for displaying commodities is formed of a lever with a square cross section, an engaging member engaging the lever, and a hook fixed to the engaging member. The lever is equipped with projections on both sides of upper and lower surfaces, and oblique surfaces formed at the lower and upper portions of the left and right sides. The oblique surfaces project gradually outwardly toward a central portion from the upper and lower ends. When the engaging member is rotated, the tool can be easily taken out from the lever.

5 Claims, 2 Drawing Sheets

TOOL FOR DISPLAYING COMMODITIES

BACKGROUND OF THE INVENTION AND RELATED ART STATEMENT

The present invention relates to a tool for displaying commodities, wherein a lever mounted on a display shelf and an edge of a hook pin are connected, and an edge of a card positioned on an upper portion of the hook pin is combined. The card is used to display and control the commodities.

In the prior art, a tool for suspending commodities comprises of a hook pin for suspending commodities, a mating or engaging member, and a lever, wherein the hook pin and the engaging member are assembled. The engaging member detachably holds the hook pin, and has a cross-section generally in an "n" shape, and a lever equipped member on a backboard of a shelf is supported by engaging the engaging member from upwards.

This kind of technology is disclosed in Japanese Utility Model Publication No. 58-131765, for example. The technical means disclosed in this publication comprises a tool for suspending commodities, which is combined with the engaging member in an "n" shape at a rear end of the hook pin for suspending commodities. The tool is engaged and supported to a lever equipped member on a rear plate of a shelf by assembling an elastic plate for displaying the commodities with an engaging portion folded in a box shape in order to surround the tool. In the tool for suspending the commodities, the lever and an elastic plate for displaying the commodities move together laterally.

The mating member in the "n" shape described in the Publication is formed of a heavy metal member. Since the metal member is fixed to the lever by engaging from upwards, a backlash occurs always by the weight when suspending the commodities. It is troublesome to attach and detach the commodities on a display shelf where many levers are mounted with narrower spaces in the up and down directions, because the commodities on an upper shelf must be removed when the supported commodity is attached or detached. Further, an inner surface of the engaging member in the "n" shape is separated from an opposing side of the lever. Since a backlash occurs due to the separation when the member moves, very troublesome operation is required unless the rear end of the tool for suspending the commodities is manipulated immediately.

The present invention has been made to solve the problem of a tool for suspending the commodities in the prior art comprising a tool for suspending commodities and an elastic plate for displaying the commodities on a shelf.

The object of the present invention is to provide a tool for suspending commodities, comprising a combination of the tool for suspending commodity with a lever, for allowing the smooth attachment and detachment of the tool for suspending the commodities to the lever, and smooth lateral movement of the tool for suspending the commodities through the lever.

Another object of the present invention is to provide a tool for displaying the commodities to which a card for indicating the commodities can be smoothly attached to and detached from the tool for suspending the commodities.

Further objects and advantages of the invention will be apparent from the following description of the invention.

SUMMARY OF THE INVENTION

In order to achieve the objects mentioned-above, the invention according to the first aspect comprises of combination of a lever in a square cross section with an engaging member. The lever is equipped with projections at both ends of upper and lower surfaces, and oblique surfaces are formed at upper and lower portions of its left and right sides projecting outwardly gradually from upper and lower portions to a central portion. An intermediate portion in a shape of a groove is formed in the middle of the oblique surfaces at the upper and lower portions. The tool for suspending the commodities further includes a hook pin fixed to the engaging member. The engaging member includes a front long tongue-shaped piece having a concave or flat portion, and an oblique surface extending from the flat portion and projecting inwardly toward a lower end of the long tongue-shaped piece, and a rear short tongue-shaped piece having an oblique portion gradually inclining inwardly and downwardly and a projected securing portion with an oblique inner surface continuing from a lower portion of the oblique surface.

The tool for suspending the commodities is easily engaged with the lever, and has no backlash toward upper and lower directions. The tool is removed by rotating the engaging member not pulling toward the up and down directions. Further, since this rotation is performed by rotation of a tip of the hook pin, it can be easily detached from the shelf on which many commodities are suspended. The engaging member contacts at least both of left and right sides of the lever. And, the tool for suspending the commodities can move laterally very easily.

In the lever, the oblique surfaces are symmetrical with respect to a center line such that they are arranged with spaces at the middle of the upper and lower portions of left and right sides. Accordingly, it is not required to select upper or lower direction when the lever is mounted, and the shelf for displaying the commodities is efficiently installed freely in the installation form.

The invention according to the second aspect comprises a supporting structure at three points, wherein an upper securing piece for securing a mating hole of a commodities indicating card, and an inserting groove for inserting and securing a rear end of the commodity card in the mating member. They do not contact other commodities displayed on the commodities displaying shelf since they are located at a free space in the shelf. The displayed commodities are not damaged nor prevent the tool for displaying commodities from moving laterally.

DETAILED DESCRIPTION OF PREFERRED EMBODIMENTS

Referring to the attached drawings, an example of the present invention is described.

Figure 1:
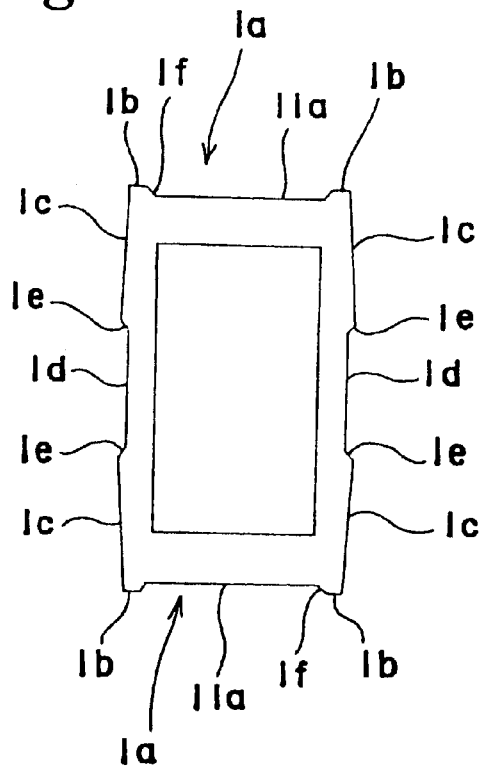
FIG. 1 is a side view for showing a lever of a tool for displaying commodities according to the present invention.

FIG. 1 shows a side view of a lever 1 of a tool for displaying commodities, which has a square in a cross section. It is preferably made of light aluminum alloy, solid resin or other material. The upper and lower surfaces include a concave or groove 1*a* with a plane 11*a* and two projections 1*b* sandwiching the concave 1*a*. On the other hand, the left and right sides are formed such that oblique surfaces 1*c* separated up and down for sandwiching a concave 1*d* at a center project gradually outwardly from the upper and lower ends to the central portion, and they are symmetrical with respect to a vertical or lateral center line.

Figure 2:
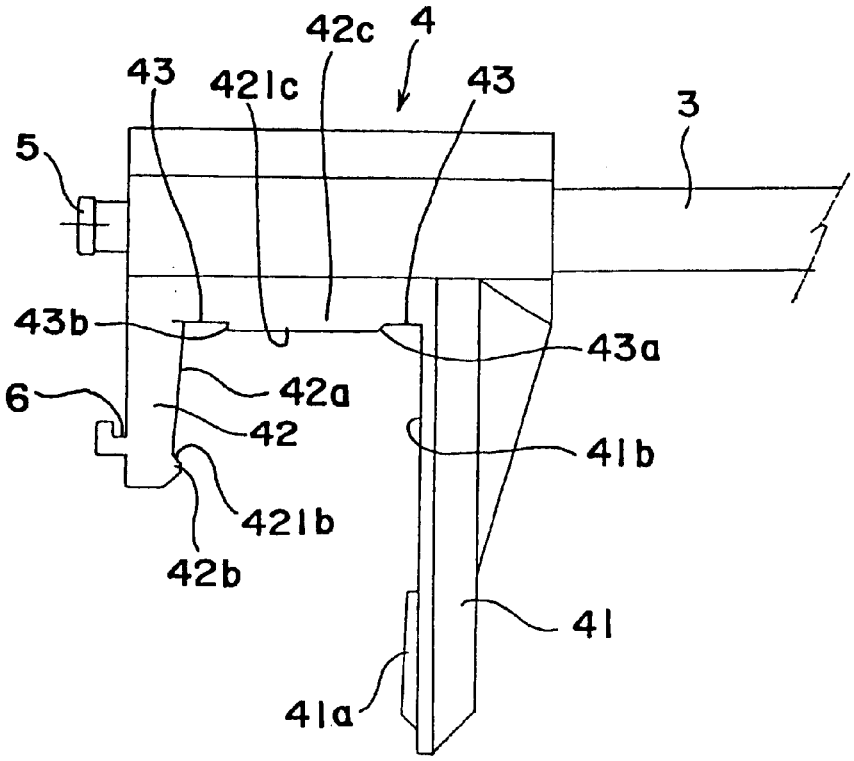
FIG. 2 is a side view for showing a tool for suspending the commodities of the tool according to the present invention.

FIG. 2 shows a side view of a tool 2 for suspending the commodities according to the present invention. It is formed of a hook pin 3 with a tip inclined upwardly, and an engaging member 4 slightly similar to an "L" shape with which the rear end of the hook pin 3 engages. The hook pin 3 has preferably elasticity to some extent, and is made of light aluminum alloy or solid resin, or other material. The engaging member 4 includes a front long tongue-shaped piece 41, and a rear short tongue-shaped piece 42. On an inner side of the front long tongue-shaped piece 41, there are a concave or flat portion 41*b* and an oblique surface or portion 41*a* extending from the lower portion of the concave 41*b* and projecting gradually outwardly to the lower end. On the other hand, on an inner side of the rear short tongue-shaped piece, there are formed an oblique concave or portion 42*a* inclining gradually inwardly toward downwardly, and a projected securing portion 42*b* with the oblique inner surface 421*b* at the lower portion continuing from the oblique portion 42*a*.

Furthermore, on an upper inner surface where the flat portion 41*b* of the front long tongue-shaped piece 41 is connected to the oblique portion 42*a* of the rear short tongue-shaped piece, a projection 42*c* with a plane 421*c* is formed, and grooves 43 are formed on the both sides. The plane 421*c* at the side of the front long tongue-shaped piece forms an oblique surface 43*a* which has the same gradient with an inner oblique surface if of the projection 1*b* of the lever 1. The plane 421*c* at the side of the short tongue-shaped piece forms a vertical wall 43*b*. And, on a rear side of the engaging member, an upper securing piece 5 with an enlarged diameter and an inserting groove 6 are formed.

Figure 3:
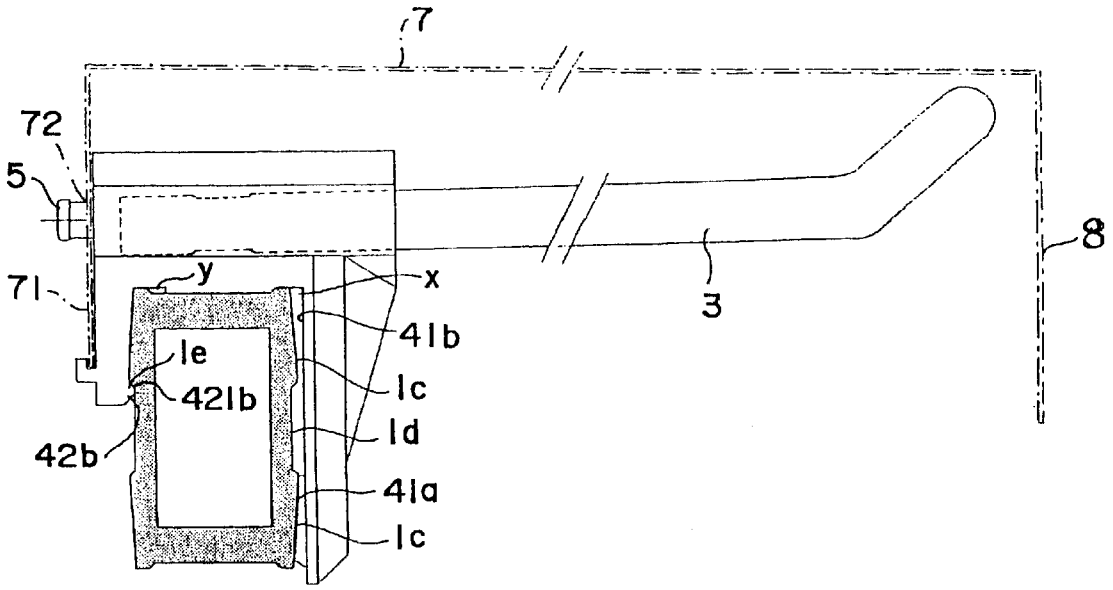
FIG. 3 is an explanatory view of an assembly of the lever and the tool for suspending the commodities of the tool according to the present invention.

FIG. 3 shows an explanatory drawing of the assembly formed by the lever 1 and the tool 2 for suspending commodities as shown in FIGS. 1 and 2. Relationship of an inner surface of the engaging member 4 with a circumferential surface of the lever 1 is explained. The flat portion 41*b* at the front long tongue-shaped piece forms a space x separated from the oblique surface lc and the concave 1*d* at an upper right position of the lever 1. The oblique surface 41*a* of the front long tongue-shaped piece contacts the oblique surface 1*c* at a lower right position of the lever 1. The oblique portion 42*a* contacts the oblique surface 1*c* at an upper left position of the lever 1, and the projected securing portion 42*b* of the rear short tongue-shaped piece contacts and engages an end 1*e* of the oblique surface 1*c* at the upper left position of the lever 1.

Further, since the plane 421*c* at the projected portion 42*c* of the engaging member is formed shorter than the length of the plane 11*a* at the concave 1*a* and the planes 421*c* and 11*a* contact each other, a space Y is formed between the inner oblique surface 1*f* of the projection 1*b* at the rear short tongue-shaped piece and the vertical wall 43*b* at the rear short tongue-shaped piece of the engaging member in the groove 43. Two projections 1*b* of the lever 1 contact the upper surfaces of the grooves 43, and the projection 42*c* contact the concave 1*a*.

Further, since the plane 421*c* at the projected portion 42*c* of the engaging member is formed shorter than the length of the plane 11*a* at the concave 1*a* and the planes 421*c* and 11*a* contact each other, a space Y is formed between the inner oblique surface 1*f* of the projection 1*b* at the rear short tongue-shaped piece and the vertical wall 43*b* at the rear short tongue-shaped piece of the groove 3 of the engaging member. Two projections 1*b* of the lever 1 contact the respective upper surfaces of the flat portion 41*b* and the oblique surface 42*a,* and the projection 42*c* engages with play and is supported in the concave 1*a*.

A rear end 71 of a card 7 for indicating the commodities is inserted and secured in the inserting groove 6 at the reverse side of the engaging member, and also, an engaging hole of the card 7 for indicating the commodities is inserted and secured in other upper securing piece 5.

Figure 4:
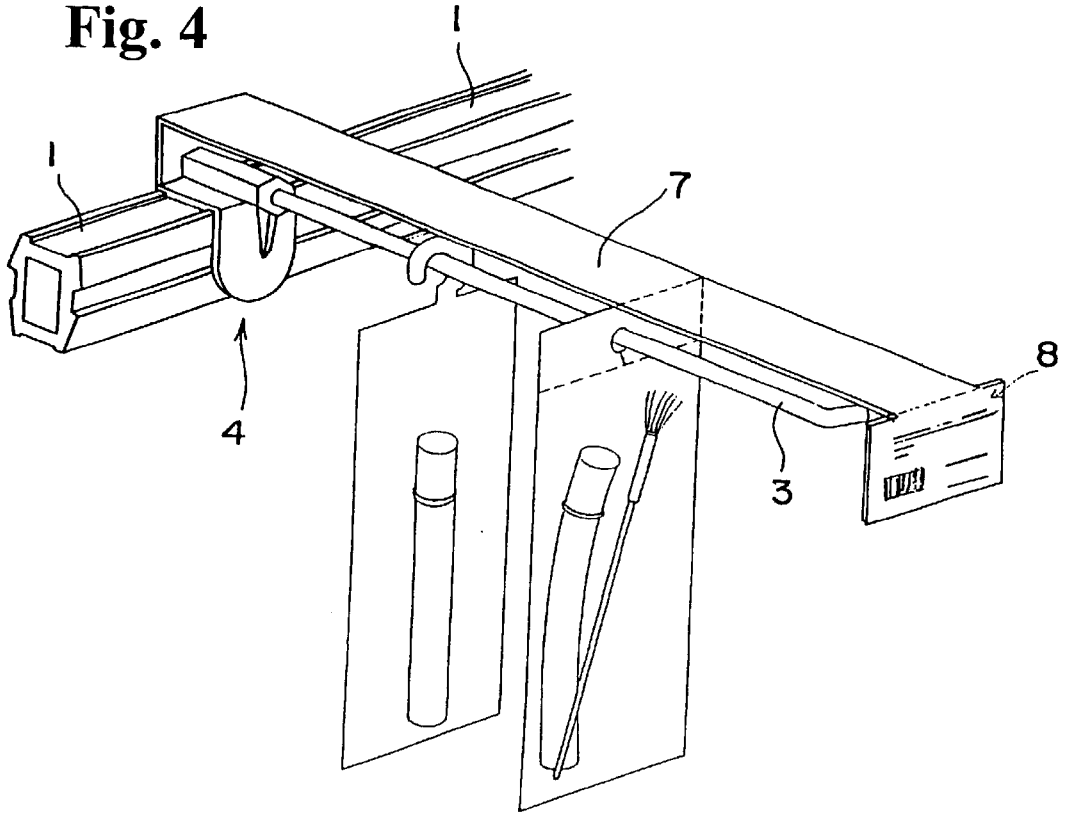
FIG. 4 is a perspective view showing an embodiment of the tool for displaying the commodities according to the present invention.

FIG. 4 is a perspective view showing a condition where the tool for displaying the commodities of the present invention is shown.

In the tool for displaying the commodities with such structure, the tool 2 for suspending the commodities is engaged with and supported by the lever 1 as shown in FIG. 4. As the upper and lower portions of the lever 1 are formed to project outwardly by the oblique surfaces 1*c* expanding gradually from the upper and lower edges toward the central direction, the engaging member in the tool 2 for suspending the commodities is easily engaged with the lever 1, and in addition, the oblique portion 41*a* at the lower portion of the front long tongue-shaped piece 41 in the engaging member 4 affects the oblique surface 1*c* of the lever 1. Further, when the upper projection 42*c* affects the plane 11*a* of the lever 1, the oblique surface 43*a* of the groove at the right side of the projection 42*c* affects the projection 1*b* at the right side of the lever 1 at the same time. Therefore, the tool for suspending the commodities does not incline downwardly to the right even if the weight is applied, and is not easily detached from the guiding lever 1 since the weight is well supported. The backlash is prevented since each square of three surfaces of the lever 1 forms contact surfaces with the engaging member, and thus the tool for suspending the commodities can slide smoothly or move laterally.

It is difficult to detach upwardly the tool 2 for suspending the commodities since the projected securing portion 42*b* of the rear short tongue-shaped piece is secured at the lower end 1*e* of the upper oblique surface 1*c* of the lever 1 and the lower oblique surface 1*c* at the side of the front long tongue-shaped piece and the lower surface 41*a* of the front long tongue-shaped piece contact pressingly. While the projected securing portion 42*b* of the engaging member 4 has the inner oblique surface 421*b,* and the oblique surface 41*a* projecting gradually outwardly and downwardly to the lower portion of the front long tongue-shaped piece has a moderately inclined angle. Thus, when the tool 2 for suspending the commodities is rotated on a vertically crossing surface with an axis of the hook pin 3, for example, by picking a projected tip of the hook pin 3, an end of the projected securing portion 42*b* mounts easily on a lower portion projecting at the upper oblique surface 1*c* of the lever 1. At the same time, the upper portion of the lever 1 moves to the spaces x, y established in a groove 43 (the lever 1 inclines to the right), and the rear short tongue-shaped 42 is enlarged and opened. Also, the oblique surface 41*a* at the lower position of the front long tongue-shaped piece 41 slides easily at the lower oblique surface 1*c* of the lever 1, and the front long tongue-shaped piece is enlarged and opened. Therefore, the tool 2 for suspending the commodities can be easily detached by the small rotation.

The shape of the circumferential surface of the lever 1 is formed symmetrical with respect to a central line, and the lever 1 is installed freely to the up and down directions in the fabrication of the shelf for displaying commodities A.

The embodiment of the tool for displaying the commodities according to the present invention is described as above. The present invention must not be limited to the embodiment above, but may be modified variously in design without deviation from the spirit of the present invention.

In the embodiment of the present invention, the guide lever is equipped with four oblique surfaces. If the guide lever is equipped with one oblique surface on each of the left and right sides relative to a diagonal line of the lever, the tool for suspending the commodities mentioned above can function properly. Therefore, it is not necessarily to limit the number of the oblique surfaces to four.

As can be easily understood from the description above, the present invention in the first aspect is formed of a combination of the lever 1 with a square cross section and the tool 2 for suspending commodities. The lever 1 is equipped with the projections 1*b* at both ends of the upper and lower surfaces, and oblique surfaces 1*c* are formed at the upper and lower portions of the left and right sides that project gradually from the upper and lower portions to a central portion. An intermediate portion in a shape of a grove is formed in the middle of the oblique surfaces at the upper and lower portions.

The tool for suspending the commodities comprises the hook pin 3 and the engaging member 4 to which the hook pin 3 is fixed. The engaging member 4 includes the front long tongue-shaped piece 41 having the flat portion 41*b* and the oblique portion 41*a* extending from the flat portion 41*b* and projecting gradually toward a lower portion thereof, and the rear short tongue-shaped piece 42 having the oblique portion 42*a* at the inner surface thereof with the thickness gradually decreasing downwardly, and the projected securing portion 42*b* with the oblique inner surface 421*b* continuing from the lower portion of the oblique concave 42*a*. The tool for suspending the commodities is easily engaged with the lever 1. The tool is removed by rotating the engaging member 4 in the up and down directions. Further, since this rotation is performed by rotating the tip of the hook pin 3, it can be easily detached from a shelf on which many commodities are suspended. The engaging member is engaged with at least both left and right sides of the lever 1. And the tool 2 for suspending the commodities can move laterally very easily.

In the lever 1, the oblique surfaces 1*c* are formed at each of the left and right side portions to have a space therebetween in a vertical direction, which are symmetrical with respect to the up-down and left-right directions. Accordingly, the shelf for displaying the commodities is efficiently installed.

In the second aspect of the present invention, the tool includes the upper securing piece 5 for securing the mating hole 72 of the commodity indicating card 7, and the inserting groove 6 for inserting and securing a rear end 71 of the commodity card 7 on the reverse side of the mating member 4. They do not contact other commodities displayed on the commodity displaying shelf since they are located at a free space in the shelf. The displayed commodities are not damaged nor prevent the tool from moving laterally.

While the invention has been explained with reference to the specific embodiments of the invention, the explanation is illustrative, and the invention is limited only by the appended claims.

What are claimed:

1. A tool for displaying commodities comprising:

an elongated lever having a rectangular shape in a cross section and including front and rear surfaces, projections formed at upper and lower ends of the front and rear surfaces, and upper and lower lever oblique surfaces formed at the front and rear surfaces, of the elongated lever, said upper and lower lever oblique surfaces in each of the front and rear surfaces gradually projecting outwardly from upper and lower ends to a central portion there of, an engaging member for engaging the lever including a front long tongue-shaped piece having a flat portion and a first oblique surface extending from the flat portion and projecting gradually outwardly toward a lower portion thereof; and a rear short tongue-shaped piece formed at a side opposite to the front long tongue-shaped piece and having a second oblique surface gradually increasing a distance relative to the long tongue-shaped piece toward downwardly and a projected securing portion with an oblique inner surface continuing from a lower portion of the oblique surface, and a hook pin engaging the engaging member for holding commodities.

2. A tool for displaying commodities according to claim 1, wherein when the engaging member is attached to the lever, the first oblique surface contacts the lower lever oblique surface at the front surface of the elongated lever, and the second oblique surface contacts the upper lever oblique surface at the rear surface of the elongated lever; the projected securing portion contacts a lower end of the upper oblique surface at the rear surface of the lever; upper surfaces above the first oblique surface and the second oblique surface contact the corresponding projections of the lever; and a space is formed between the upper front oblique surface of the lever and the flat portion of the front long tongue-shaped piece.

3. A tool for displaying commodities according to claim 2, wherein the elongated lever includes center grooves between the projections formed at the upper and lower ends of the front and rear surfaces of the lever.

4. A tool for displaying commodities according to claim 3, wherein said engaging member includes a connecting piece situated between the long and short tongue-shaped pieces and having an intermediate projection and two lateral grooves sandwiching the intermediate projection at a lower surface of the connecting piece so that when the engaging member is assembled with the lever, the projection at the upper end of the rear surface of the lever is located in leaving to the rear short tongue-shaped piece leaving a space with respect to said intermediate projection.

5. A tool for displaying commodities according to claim 1, wherein the engaging member includes an upper securing piece for receiving an engaging hole of an indicating card, and an inserting groove for receiving a rear end of the indicating card.

* * * * *